US008763508B2

(12) United States Patent
Coker et al.

(10) Patent No.: US 8,763,508 B2
(45) Date of Patent: Jul. 1, 2014

(54) HIGH ATTRITION, RAPID DISPERSAL X 8 (H.A.R.D. 8) EXTREME RATE OF FIRE WEAPON SYSTEM

(75) Inventors: Gary L. Coker, Roswell, NM (US); John Timothy Roberts, Roswell, NM (US); David M. Stevens, Roswell, NM (US); Charles C. McPherson, Roswell, NM (US)

(73) Assignee: Prometheus Solutions, Inc., Roswell, NM (US)

( * ) Notice: Subject to any disclaimer, the term of this patent is extended or adjusted under 35 U.S.C. 154(b) by 166 days.

(21) Appl. No.: 13/386,592

(22) PCT Filed: Jul. 20, 2010

(86) PCT No.: PCT/US2010/042665

§ 371 (c)(1),
(2), (4) Date: Jan. 23, 2012

(87) PCT Pub. No.: WO2011/046653

PCT Pub. Date: Apr. 21, 2011

(65) Prior Publication Data

US 2012/0118132 A1 May 17, 2012

Related U.S. Application Data

(60) Provisional application No. 61/227,573, filed on Jul. 22, 2009.

(51) Int. Cl.
*F41A 21/06* (2006.01)

(52) U.S. Cl.
USPC ..... 89/13.05; 89/12; 89/1.41

(58) Field of Classification Search
USPC ..... 89/1.41, 12, 13.05
See application file for complete search history.

(56) References Cited

U.S. PATENT DOCUMENTS

| | | | | | |
|---|---|---|---|---|---|
| 290,622 | A | * | 12/1883 | Accles | 89/33.02 |
| 332,741 | A | * | 12/1885 | Palmer | 89/12 |
| 1,164,498 | A | * | 12/1915 | Glov | 89/13.05 |
| 1,307,316 | A | * | 6/1919 | O'Malley | 89/13.05 |
| 1,328,230 | A | * | 1/1920 | Johnston | 89/12 |
| 1,399,119 | A | * | 12/1921 | Hodges | 89/33.03 |

(Continued)

OTHER PUBLICATIONS

International Search Report dated Jun. 10, 2011 for PCT/US2010/42655 filed Jul. 20, 2010.

(Continued)

*Primary Examiner* — Samir Abdosh
(74) *Attorney, Agent, or Firm* — Gardere Wynne Sewell LLP; Chris P. Perque; Teresa J. Lechner-Fish

(57) ABSTRACT

An weapon system comprising: a plurality of barrels, wherein the barrels are disposed coaxially around a main shaft and wherein the barrels are held in place by at least one barrel rack; and a plurality of intermeshing, counter rotating cylinders, wherein the cylinders include a central hole for the main shaft or a lower shaft and a plurality of coaxial half-holes disposed around the central hole at the edge of the cylindrical shape to form a chamber when the cylinders mesh. An ammunition belt comprising: a first and second ammunition case, wherein each ammunition case comprises: a casing having a first and second end, wherein the first end is adapted to receive and hold a primer and the second end is adapted to receive and hold propellant and a projectile, wherein the first ammunition case is attached to the second ammunition case.

28 Claims, 11 Drawing Sheets

(56) References Cited

U.S. PATENT DOCUMENTS

| | | | | | |
|---|---|---|---|---|---|
| 1,424,751 | A | * | 8/1922 | Bangerter | 89/126 |
| 2,317,579 | A | * | 4/1943 | Bacon | 42/39.5 |
| 2,426,527 | A | | 8/1947 | Sanford | |
| 2,970,521 | A | | 2/1961 | Bell | |
| 2,983,223 | A | | 5/1961 | Dardick | |
| 3,041,939 | A | | 7/1962 | Dardick | |
| 3,046,890 | A | | 7/1962 | Dardick | |
| 3,262,367 | A | * | 7/1966 | Martwick et al. | 89/13.05 |
| 3,429,220 | A | | 2/1969 | Goode | |
| 3,434,380 | A | | 3/1969 | Dardick | |
| 3,467,276 | A | | 9/1969 | Dardick | |
| 3,507,219 | A | | 4/1970 | Dardick | |
| 3,540,345 | A | * | 11/1970 | Wolfe | 89/13.05 |
| 3,611,871 | A | * | 10/1971 | Kirpatrick et al. | 89/127 |
| 3,688,637 | A | * | 9/1972 | Tan | 89/12 |
| 3,698,283 | A | * | 10/1972 | Ashley et al. | 89/12 |
| 3,762,328 | A | | 10/1973 | Rocha | |
| 3,855,931 | A | | 12/1974 | Dardick | |
| 4,934,244 | A | * | 6/1990 | Johnson, Jr. | 89/12 |
| 5,315,913 | A | | 5/1994 | Rossier et al. | |
| 5,580,474 | A | | 12/1996 | Smith | |
| 6,152,125 | A | | 11/2000 | Piper | |
| 6,578,463 | B1 | | 6/2003 | Ross, Jr. | |
| 6,742,434 | B1 | | 6/2004 | Dillon | |
| 7,073,426 | B1 | | 7/2006 | White | |
| 2005/0011349 | A1 | | 1/2005 | Rohrbaugh et al. | |
| 2005/0262996 | A1 | * | 12/2005 | O'Dwyer | 89/12 |
| 2006/0207418 | A1 | * | 9/2006 | Burke | 89/12 |
| 2007/0261587 | A1 | | 11/2007 | Chung | |
| 2008/0092726 | A1 | * | 4/2008 | Dillon | 89/12 |
| 2012/0118132 | A1 | * | 5/2012 | Coker et al. | 89/13.05 |
| 2012/0227577 | A1 | * | 9/2012 | Dillon | 89/12 |

OTHER PUBLICATIONS

Written Opinion of the ISA dated Jun. 10, 2011 for PCT/US2010/42655 filed Jul. 20, 2010.

Honeywell Multiple Grenade Launcher Mk18Mod 0 (HMGL) 40mm, Manufactured byHoneywell Corporation, Hopkins, Minnesota. Technology Week, Feb. 6, 1967. References: Chinn, George M. The Machine Gun. vol. V. Edwards Brothers Publishing Co. Ann Arbor, Mi. 1987.

* cited by examiner

HIGH ATTRITION, RAPID DISPERSAL X 8 (H.A.R.D. 8) EXTREME RATE OF FIRE WEAPON SYSTEM

CROSS-REFERENCE TO RELATED APPLICATIONS

The present application claims priority to U.S. Provisional Application Ser. No. 61/227,573 filed on Jul. 22, 2009, for "High Attrition, Rapid Dispersal×8 (H.A.R.D. 8) Extreme Rate of Fire Weapon System."

TECHNICAL FIELD

This invention relates generally to Gatling machine guns, and more particularly to improvements therein that serve to significantly improve their operational reliability.

BACKGROUND OF THE INVENTION

This improved automatic weapon system results from redesign and reduced component structure of weapons based upon the basic Gatling type design as described in the U.S. Pat. No. 502,185 to R. J. Gatling, and U.S. Pat. No. 2,849,921 to H. M. Otto, and reduced electrical power requirements as an improvement to drive motor requirement systems as described in U.S. Pat. No. 3,143,922 to S. Altschuler, et al.

In the traditional Gatling type design, each ammunition round (i.e., cartridge) must be fed into a receiver in one direction, then its direction of movement must be changed by ninety degrees to insert the ammunition round into a conventional breech for firing. Then, after the round is fired, the direction of movement of the spent cartridge casing must again be changed one hundred and eighty degrees to be extracted from the breech. After these changes in movement, each cartridge casing's direction of movement must be changed again by ninety degrees to extract the casing from the weapon. All of these changes in the direction of movement of the ammunition round require great amounts of energy and are prone to malfunction.

Accordingly, a weapon system that does not require the traditional changes in directional movement of ammunition, that eliminates the complex sub-assemblies necessary to change the directional movement of ammunition, and that continues to operate when an ammunition defect fails to produce producer gases, that reduces maintenance of the system, is radically different from existing technology.

SUMMARY OF THE INVENTION

This extreme rate of fire automatic weapon system is based on simplified Gatling revolving barrel firearm principles, where the barrel rack and the eight barrel assembly revolve around a central axis point and a sealed chamber forms around an ammunition round when two intermeshing, counter rotating cylinders mesh and an ammunition belt is drawn into the process. The weapon system is premised upon ammunition moving in a single constant direction which eliminates the traditional requirement of ammunition moving in multiple directions for breech loading and extracting functions using extract mechanisms or producer gases for basic operation. Additionally, because this weapon system does not require the traditional changes in directional movement of ammunition, none of the mechanisms required for the multiple directional changes in movement of ammunition are required. Obviously, without the presence of these mechanisms, none of these mechanisms can malfunction. The resulting weapon is lighter, faster, consumes less energy, and is much more reliable.

Further, the incorporation of the breech portion of the barrel into the ammunition belt provides additional security features in the event that the weapon system falls into unauthorized control because standard belted NATO rounds cannot be fired from this design without the incorporation of a sealed breech component.

The invention described herein relates to a specialized weapon system utilizing basic physical principles to optimize and simplify the Gatling design of multiple barreled rotating machine guns which feed and actuate (i.e., fire) specified ammunition. In particular, the new weapon system eliminates reliance on mechanical feeders, de-linkers, bolts and ejectors for continuous dispersal of projectiles by means of supplying an ammunition belt to the intermeshing, counter rotating cylinder portion of the weapon and removing the complex sub-assemblies traditionally employed for round preparation, breech feeding and spent case extraction.

The primary object of the invention is to eliminate the necessity of and reliance on, intricate, delicate and numerous sub-assemblies traditionally required to achieve the primary objective of rapid firing of multiple barrel machine gun assemblies. The weapon system does not chamber ammunition rounds in the traditional sense, and, thus, the new design increases efficiency and speed of operation by eliminating the necessity of changing the momentum, movement and direction of the ammunition during the mechanical firing process. By basing the operation of the machine gun around this guiding principle, the weapon system eliminates the requirement of additional sub-assemblies to mechanically move ammunition via a bolt system into the traditional breech and the subsequent reverse action to extract the round from the breech, and thus, the design increases efficiency and reliability and decreases required mechanical movement and the energy necessary for that movement and further decreases mechanical processes and energy requirements that could cause potential failure.

Further, the design eliminates the need to de-link every ammunition round (i.e., cartridge) before it enters the chamber. The design allows the ammunition links to be fed directly through the cylinder assemblies, fired, and ejected out the other side. This eliminates the need for additional complex sub-assemblies to de-link the cartridges, and reduces heat buildup. Accordingly, ammunition "cook offs" will be virtually eliminated due to the reduction in heat.

A further object of the invention is to eliminate the need for breech loading and extraction mechanisms or successful explosion of ammunition to function. This weapon system eliminates the traditional breech loading function. This system also eliminates current technology reliance on extraction mechanisms or successful explosion of ammunition and the resulting production of producer gases to operate. These features allow the new system to continue to operate based on mechanical drive principles and will not cease to function if defects in ammunition cause a failure in the production of producer gases. Similarly, because there is no traditional breech loading and extraction, there can be no malfunction in these areas.

A further object of the invention is to reduce maintenance requirements. By a general fifty percent reduction in required moving parts over conventional bolt reliant weapons to operate, and the elimination of the necessity of production of producer gasses to function, this weapon system is far less complex and significantly more reliable than the traditional design.

A further object of the invention is to eliminate the necessity of a host vehicle power source for operation. The weapon system is designed to function independently from a host vehicle power source using its own internal battery power and to be able to interact with a host vehicle power source for operation. The system reduces mechanical parts requiring force for movement to reduce power requirements, and streamlines ammunition directional flow principles to provide a lower system resistance. Thus, the new design requires significantly less than currently accepted minimum standard power requirements and current draw to operate efficiently.

Still, other objects, features, and advantages of the present invention will be apparent from the following description of the preferred embodiments, given for the purpose of disclosure, and taken in conjunction with the accompanying drawings.

BRIEF DESCRIPTION OF THE DRAWINGS

For a further understanding of the nature and objects of the present inventions, reference should be made to the following detailed disclosure, taken in conjunction with the accompanying drawings, in which like parts are given like reference numerals, and wherein.

DETAILED DESCRIPTION OF PREFERRED EMBODIMENTS OF THE INVENTIONS

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto to be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Figure 1:
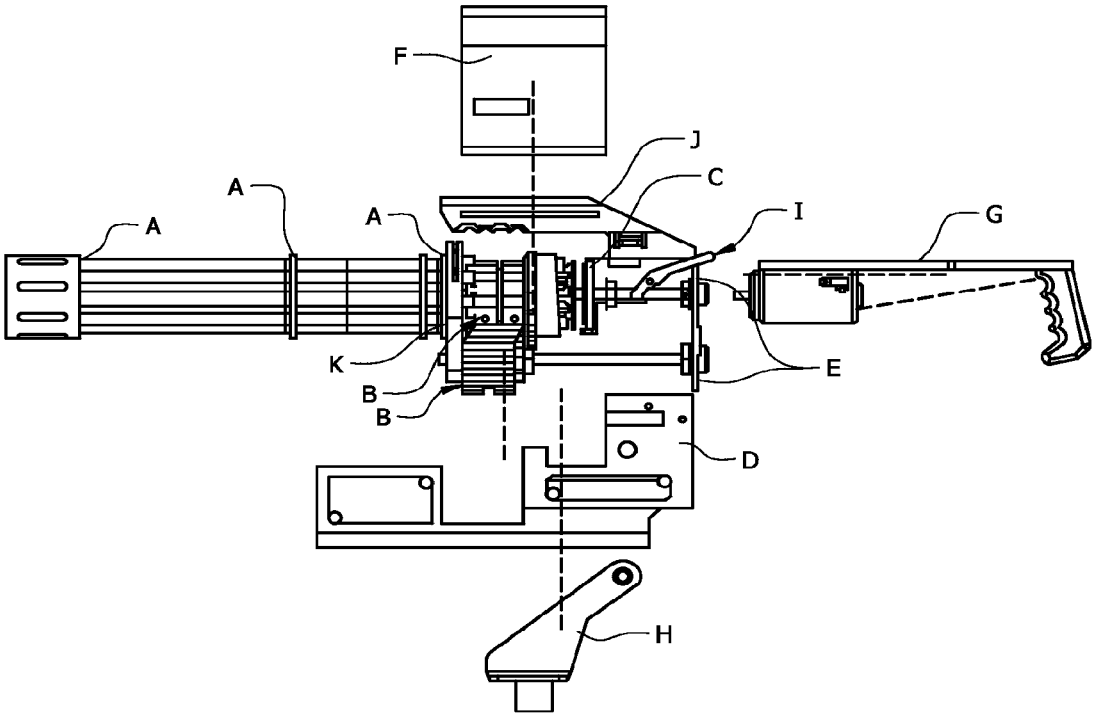
FIG. 1 is a longitudinal exploded side view of the machine gun with the individual pieces identified as functional groups as they interact and connect to adjacently identified components.

A cross-sectional view of an embodiment of a machine gun is shown in FIG. 1. As shown in FIG. 1, the basic machine gun 1 is depicted as a set of integral sub-assemblies: A) barrel and rack assembly (FIG. 8), B) counter rotating cylinders and ammunition belt assembly (FIG. 6), C) firing pin spool and cam assembly (FIG. 2), D) main receiver assembly (FIG. 9), E) counter rotating cylinders assembly (FIG. 3), F) weapon cover assembly, G) stock, drive motor, and grips assembly (FIG. 11), H) optional weapon swivel mount assembly (FIG. 1), I) safety assembly (FIG. 11), J) handle assembly (FIG. 5), and K) cylinder retainer assembly (FIG. 4).

Figure 2:
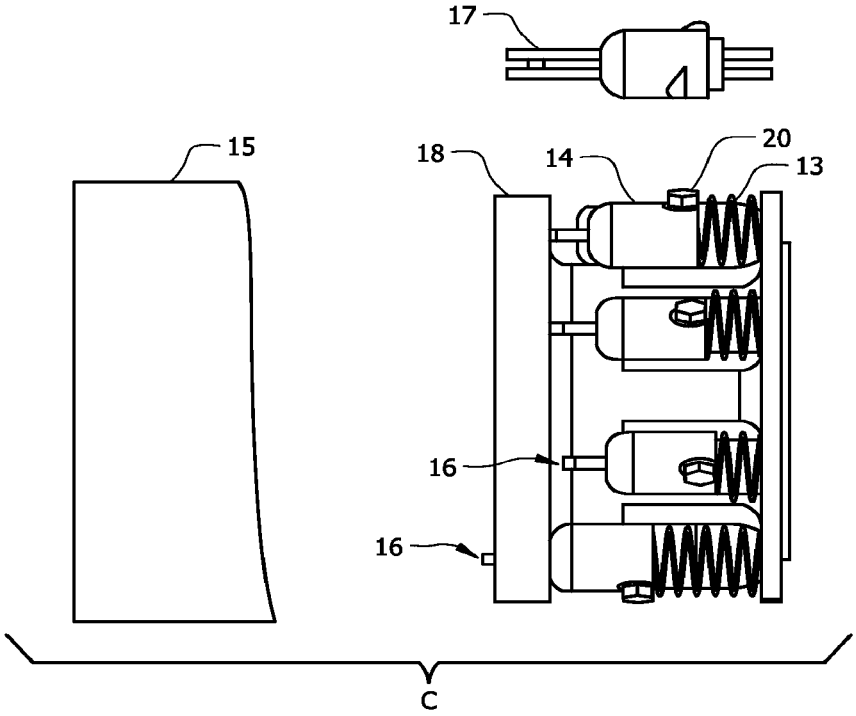
FIG. 2 is a fragmentary sectional top view of the firing pin spool with cylinders omitted to illustrate the internal subcomponents, and with the inclined cam shown in the removed configuration and the firing pin blocks exploded to illustrate interaction.
Figure 6:
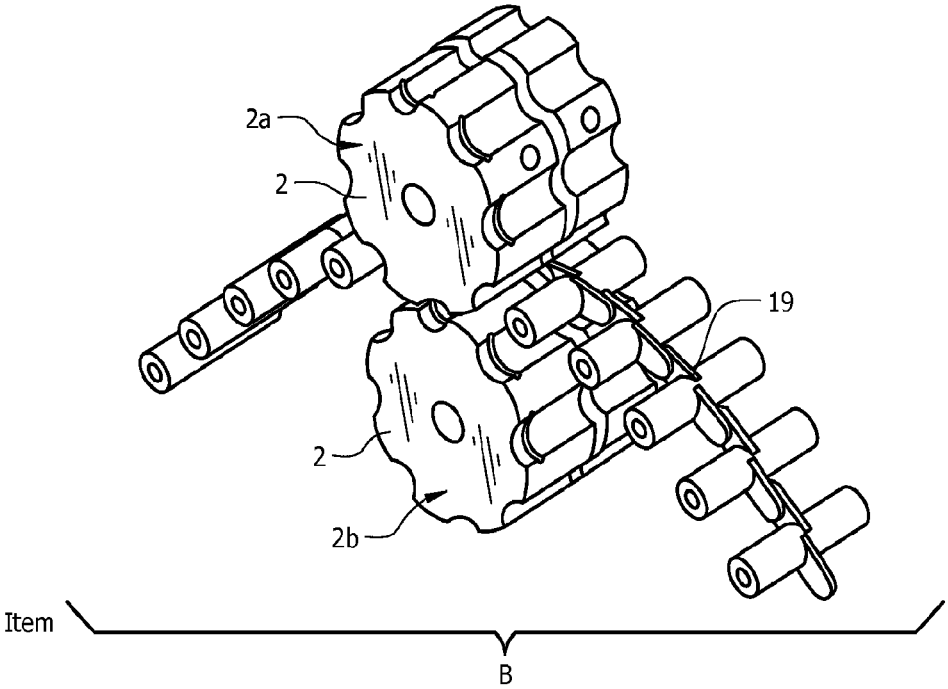
FIG. 6 is a fragmentary sectional view of the counter rotating cylinders with belted ammunition from the same point of view as FIG. 3 and FIG. 4 with the firing pin spool omitted to illustrate the relationship between the cylinders and ammunition.

As shown in FIG. 2, the firing pin spool 18 contains eight dedicated firing pin springs 13 to propel each of the eight firing pins 16 sequentially into an ammunition round 19 (FIG. 13) or 69 (FIG. 14) in the intermeshing, counter-rotating cylinders 2*a* and 2*b* at the six o'clock position on the upper cylinder 2*a* (FIG. 6) and the twelve o'clock position on the lower cylinder 2*b* (FIG. 6). The firing pins 16 may be made of any suitable material. In a preferred embodiment, the firing pins 16 are made from a tool steel tight tolerance rod. The firing pin spool 18 (FIG. 2) rotates on a firing pin cam 15 on cam bearings 20 which perform through the mechanical "cocking" process. The firing pin spool 18 may be made of any suitable material. In a preferred embodiment, the firing pin spool 18 is made from a low carbon steel rod.

As shown in FIG. 2, the firing pin cam 15 is an inclined sleeve that encloses the firing pin spool 18 that is the carrier of the mounted firing pin blocks 14 that contain the fixed firing pins 16. The firing pin cam 15 may be made of any suitable material. In a preferred embodiment, the firing pin cam 15 is made from carbon steel tubing. The dedicated firing pin springs 13 provide the physical force required to snap each firing pin block 14 forward as it exits the ramp on the firing pin cam 15, which point is mechanically determined by the inclined ramp shape and positioning of the cam 15 on which the firing pin spool 18 and independent firing pin blocks 14 ride about the central axis. This process fires each ammunition round 19 or 69 when the counter rotating cylinders 2*a* and 2*b* (FIG. 6) and the firing pin blocks 14 reach the firing point, i.e., the six o'clock position on the top cylinder and 12 o'clock position on the bottom cylinder.

Each firing pin block 14 is secured into the firing pin spool 18 by means of two firing pin guide rods 17 that provide directional stability of the firing pin block 14. The firing pin guide rods 17 may be made of any suitable material. In a preferred embodiment, the firing pin guide rod 17 is made from a hardened steel rod. The firing pin block 14 is mechanically cocked as it orbits inside the inclined firing pin cam 15.

The firing pin blocks 14 contain an externally mounted cam bearing 20 that rides on the aft side of the inclined firing pin cam 15 and that provides the "cocking" action of the individual firing pin blocks 14 to supply the necessary energy required to discharge the fed ammunition rounds when the drop off point on the cam 15 is reached. The cam bearing 20 may be any suitable bearing. In a preferred embodiment, the cam bearing 20 is a miniature precision stainless steel ball bearing.

Figure 5:
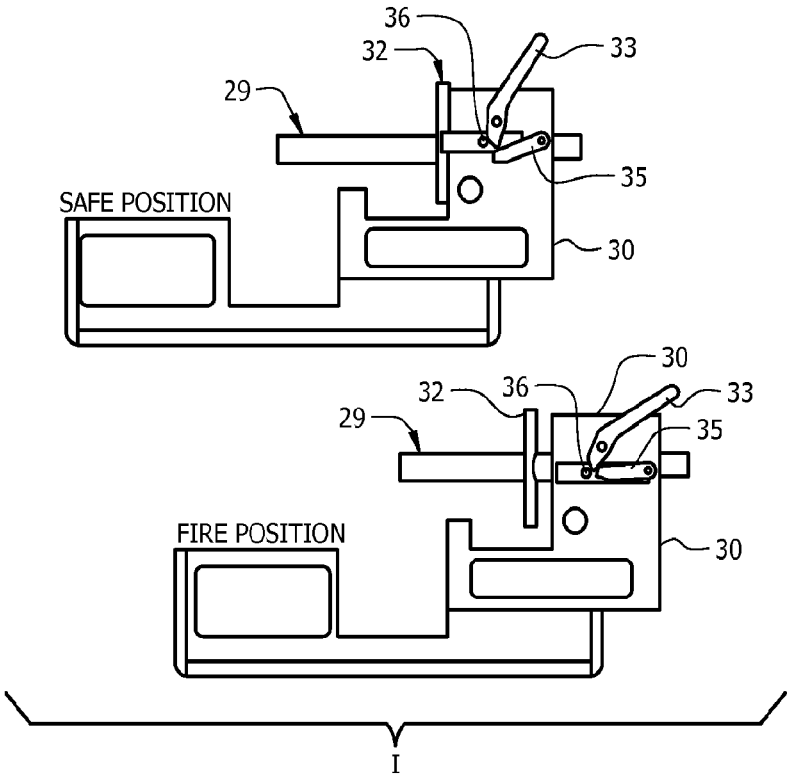
FIG. 5 is fragmentary sectional views of the pressure plate and safety slide assemblies in the "SAFE" and "FIRE" positions.
Figure 11:
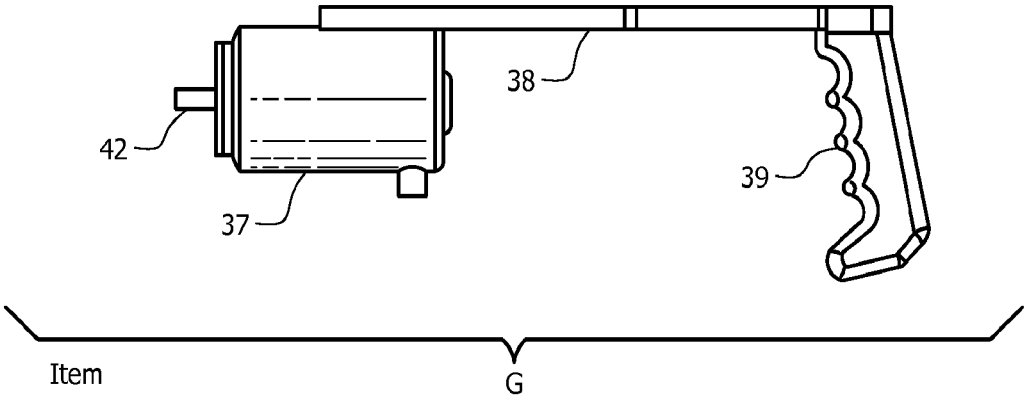
FIG. 11 is a fragmentary side sectional view of the drive motor, stock and grip and trigger assembly, with the individual pieces identified as they interact and connect to adjacently identified components from the same point of view as shown in FIG. 1.

As shown by FIG. 11, the rotation of the barrel assembly (FIG. 8) is provided by the motor drive shaft 42 (FIG. 11) connected to the drive motor 37 (FIG. 11) through the pressure plate 32 assembly. The firing pin spool 18 can be engaged or disengaged by operation of the safety lever 33. The safety lever 33 operates the pressure plate 32 assembly. The upper view of FIG. 5 shows the safety system in the "SAFE" position. The lower view of FIG. 5 shows the safety system in the "FIRE" position. With the pressure plate 32 assembly positioned AFT (FIG. 5, upper view), the firing pin spool (FIG. 2) is also positioned AFT and the tension on the firing pin block springs 13 is eliminated and, thus, the "firing" process is disabled. In this configuration, the counter rotating cylinders 2*a* and 2*b* (FIG. 3) and the firing pin spool 18 (FIG. 2) can be rotated in either direction, and, thus, no engagement is possible of the firing pin blocks 14 (FIG. 2) to fire the weapon.

Figure 3:
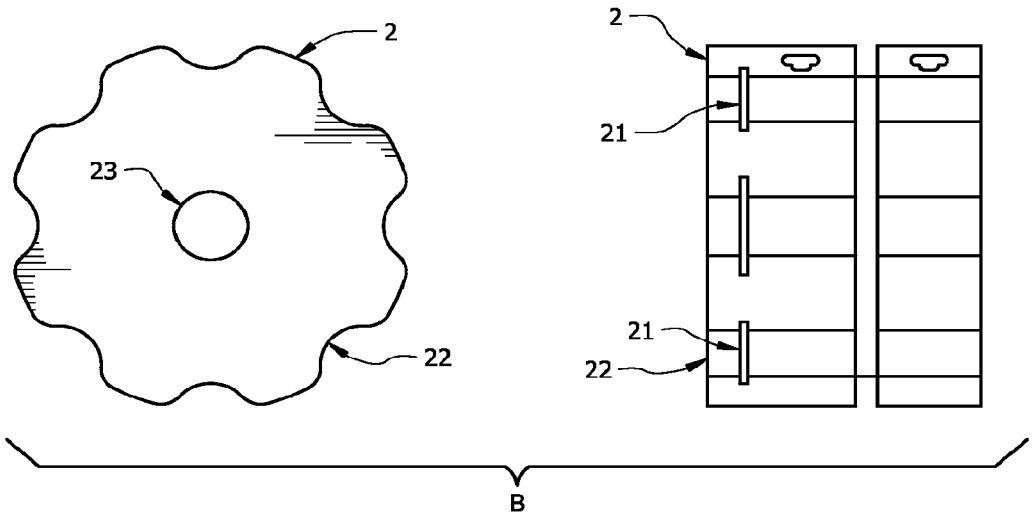
FIG. 3 is a fragmentary sectional rear and side view of the counter rotating cylinder(s) to illustrate the relation of the interlocking components of the cylinders.
Figure 4:
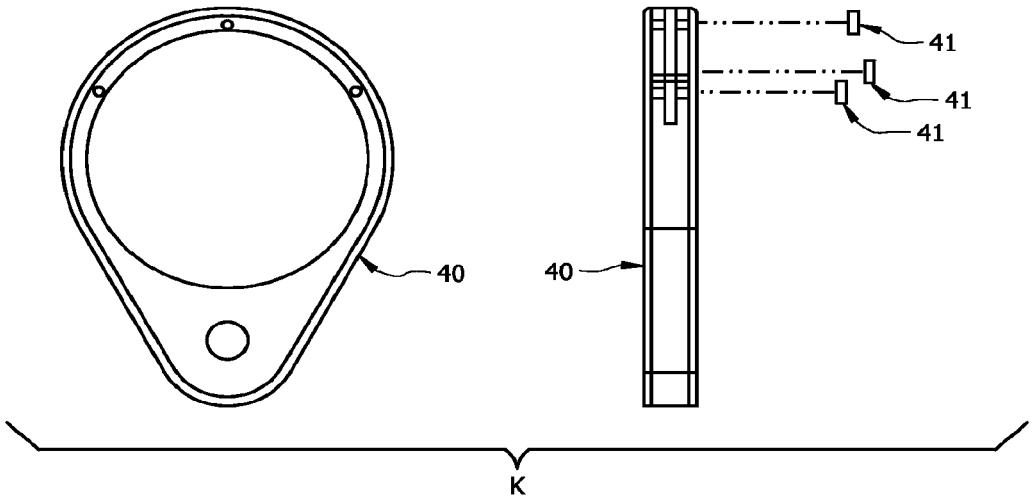
FIG. 4 is a fragmentary sectional rear and side view of the cylinder shaft retainer ring from the same relational point of view as FIG. 3.
Figure 8:
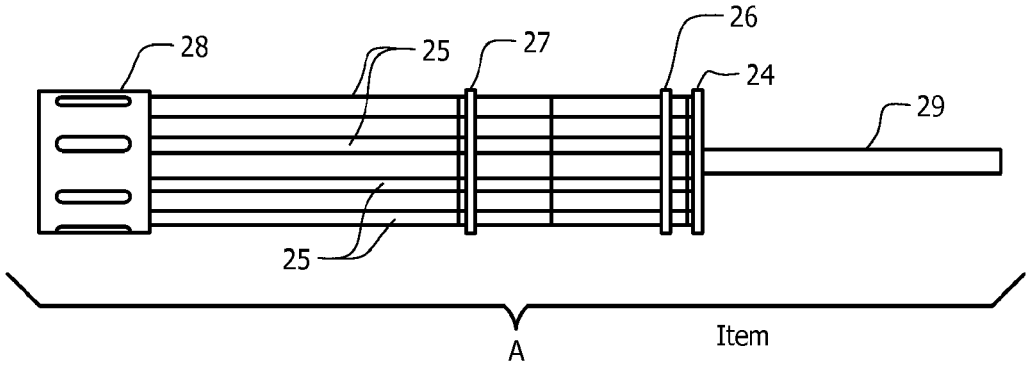
FIG. 8 is a fragmentary sectional side view of the barrel and rack assemblies with the individual pieces identified as they interact and connect to adjacently identified components from the same point of view as shown in FIG. 1.

As shown in FIG. 8, the barrel assembly is comprised of a unique set of eight barrels 25 that are attached to a main receiver 30 (FIG. 9) by the main shaft 29 through the main shaft mounting hole 23 (FIG. 3) in the cylinder 2*a* (FIG. 3). The barrels 25 are interlocked into the counter rotating cylinders 2*a* and 2*b* (FIGS. 3 and 6) by means of a flanged barrel butt 24 that fits into a barrel interlock grove 21 (FIG. 3) in the counter rotating cylinders 2*a* and 2*b* (FIG. 3). The barrels 25 are centrally clamped into place by a front barrel rack 27 and a rear barrel rack 26, and laterally stabilized by the muzzle flash suppressor 28. The barrels 25 may be made of any suitable material. In a preferred embodiment, the barrels 25 are made from chromoly steel, stainless steel, titanium and combinations thereof. The barrel racks 26, 27 and flash suppressor 28 may be made of any suitable material. In a preferred embodiment, the barrel racks 26, 27 and flash suppressor 28 are made from a low carbon steel rod.

The barrel assembly (FIG. 8) comprises eight separate barrels which, at the aft end interlock with the intermeshing, counter rotating drive cylinders 2*a* and 2*b* and form the barrel interlock chamber 22 (i.e., breech) portion of the weapon. The counter rotating cylinders 2*a* and 2*b* may be made of any suitable material. In a preferred embodiment, the counter rotating cylinders 2*a* and 2*b* are made from carbon steel, titanium and combinations thereof. The upper drive cylinder 2*a* (FIGS. 3 and 6) is connected to the barrel assembly (FIGS. 8 and 10) by means of a main shaft 29 (FIGS. 8, 9 and 10) that is compressed through the main shaft mounting hole 23 (FIG. 3). The main shaft 29 (FIGS. 9 and 11) is attached to the motor drive shaft 42, which rotates the barrel assembly (FIG. 8) and cylinders 2*a* and 2*b*.

Figure 7:
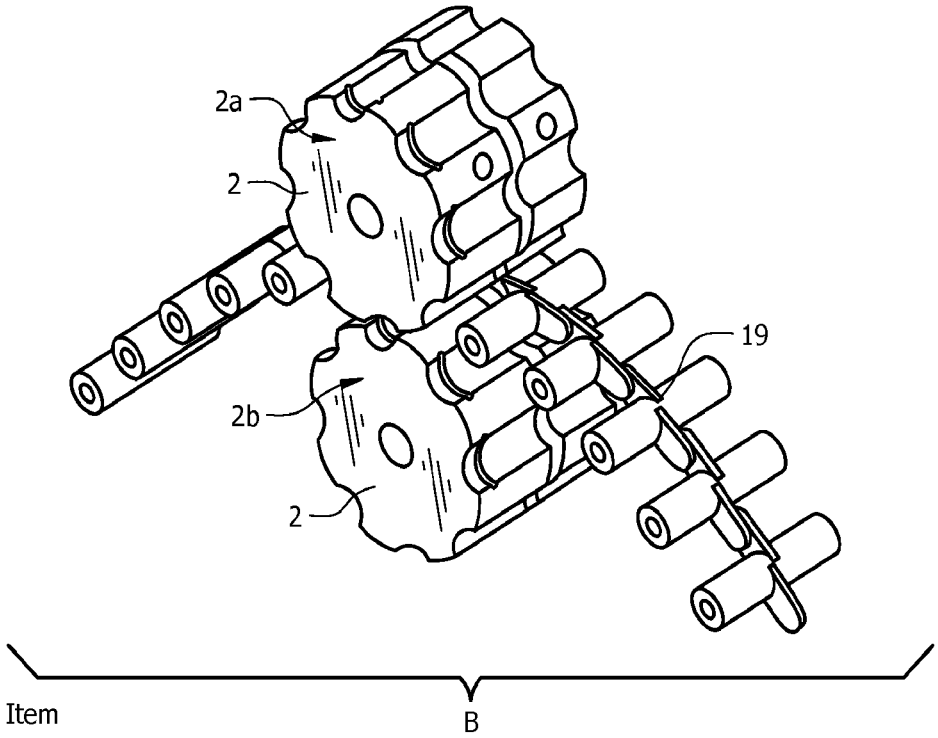
FIG. 7 is a fragmentary sectional side view of the counter rotating cylinders with an ammunition belt to illustrate the relationship between the cylinders and the ammunition belt from the same point of view as shown in FIG. 1.

As shown in FIG. 6, the lower cylinder 2*b* is identical to the upper cylinder 2*a* with the exception of the barrel assembly (FIGS. 8 and 10) attachment. The lower cylinder 2*b* is connected to the main receiver 30 by means of a lower shaft 31 that is compressed through the lower shaft mounting hole 23 (FIG. 3). A sealed barrel interlock chamber 22 (i.e., breech) is formed around the individual ammunition round 19 or 69 when the two intermeshing, counter rotating cylinders 2*a* and 2*b* mesh (FIGS. 6 and 7). The ammunition round 19 or 69 is in the firing position when the sealed chamber 22 is formed (FIGS. 6 and 7), at which time, in concert with the firing pin spool 18 (FIG. 2), the dedicated, spring loaded firing pin block 14 (FIG. 2) releases its energy by means of the firing pin cam 15 (FIG. 2) drop off point is reached and the contained firing pin 16 (FIG. 2) strikes the primer in the cartridge case head, causing the projectile to exit the properly positioned barrel (FIG. 8). As the drive motor 37 (FIG. 11) continues to rotate the counter rotating cylinders 2*a* and 2*b* (FIG. 6) the spent cartridge is expelled from the opposite side of the weapon. As the process continues, the counter rotating cylinders 2*a* and 2*b* rotate to form another chamber around the next ammunition round 19 or 69. This process will continue until the firing pin spool 18 (FIG. 2) is physically disengaged by means of the pressure plate 32 assembly (FIG. 5) actuated by the safety lever 33 (FIG. 5) or rotation of the counter rotating cylinders 2*a* and 2*b* (FIG. 6) ceases.

Figure 9:
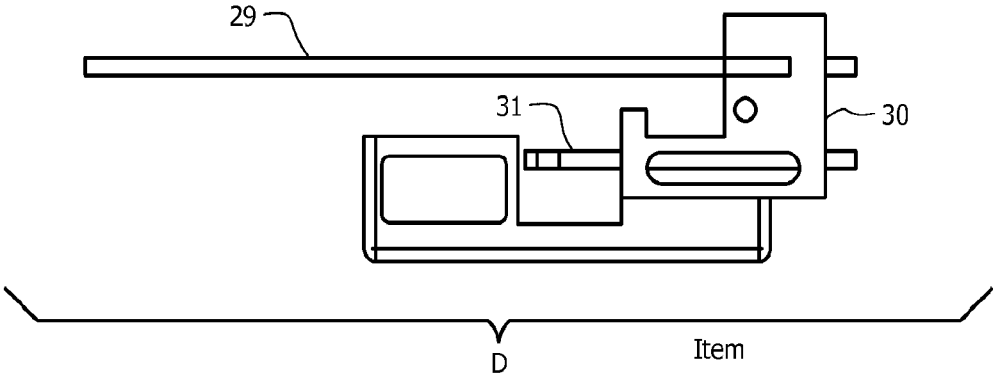
FIG. 9 is a fragmentary sectional side view of the main receiver housing and shaft with the counter rotating cylinders and firing pin spool omitted and the individual components identified as they interact and connect to adjacently identified components from the same point of view as FIG. 1.
Figure 10:
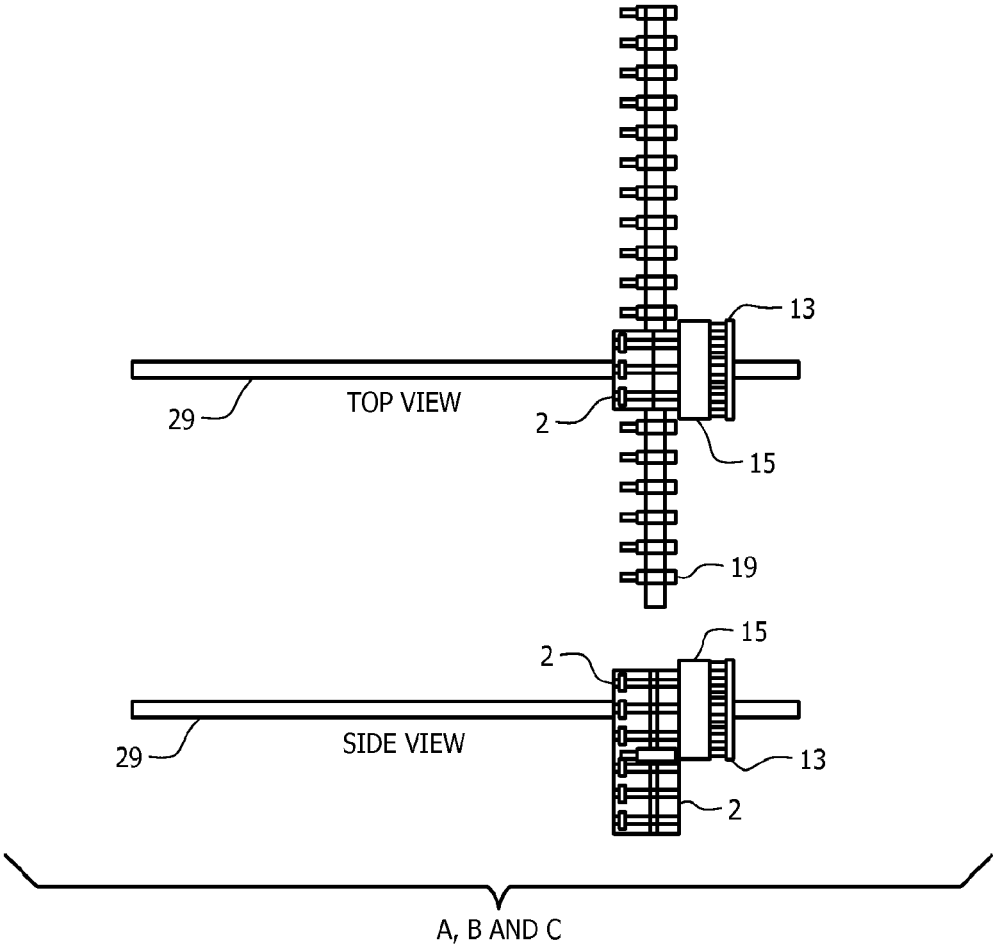
FIG. 10 is fragmentary top and side sectional views of the firing pin spool, cam, cylinder and ammunition belt assemblies, with the individual pieces identified as they interact and connect to adjacently identified components from the same point of view as shown in FIG. 1.

As shown by FIG. 9, the main receiver 30 is machined with precision milled ports to allow for the mounting of the lower shaft 31 and the main shaft 29 (FIGS. 8 and 10). The main receiver 30 may be made of any suitable material. In a preferred embodiment, the main receiver 30 is made from an aluminum sheet. The main receiver 30 is shaped to accept the counter rotating cylinders 2*a* and 2*b* (FIG. 3), and to serve as an integration piece that provides the support for the main shaft 29 and the lower shaft 31 (FIGS. 8 and 10). The main shaft 29 and lower shaft 31 may be made of any suitable material. In a preferred embodiment, the upper shaft 29 and lower shaft 31 are made from a hardened precision steel shaft.

The drive motor 37 (FIG. 11) is the mechanism that provides rotational energy to the system. The drive motor 37 is designed as a low power consumption, variable speed, and bi-directional electrical motor. The power requirements to accomplish the rotation of the counter rotating cylinders 2*a* and 2*b* are low due to reduced internal resistance of interacting parts required to accomplish continuous operation. The drive motor 37 is mounted to the stock 38 (FIG. 11) to secure the motor to the machine gun assembly. The drive motor shaft 42 (FIG. 11) is attached to the main shaft 29 (FIGS. 8, 9 and 10), and spins the main shaft 29 and the attached barrel assembly (FIG. 8), counter rotating cylinders 2*a* and 2*b* (FIG. 3) and firing pin spool 18 (FIG. 2) whenever power is selected by means of the variable speed trigger and grip assembly 39 (FIG. 11).

The cylinder retainer frame 40 (FIG. 4) attaches to the main receiver 30 (FIG. 9) and provides forward stability to the counter rotating cylinders 2*a* and 2*b* (FIG. 3) to keep the cylinders 2*a* and 2*b* in a fixed, cylindrical configuration during round activation (i.e., firing). The cylinder retainer frame 40 may be made of any suitable material. In a preferred embodiment, the cylinder retainer frame 40 is made from aluminum alloy block. The cylinder retainer frame 40 (FIG. 4) is disposed around the aft end of the barrel assembly (FIG.

8), and is configured with three internally mounted cylinder retainer frame bearings 41 (FIG. 4) that secure the barrel assembly (FIG. 8) in place while allowing the barrel assembly (FIG. 8) to rotate. The retainer frame bearings 41 may be any suitable bearing. In a preferred embodiment, the retainer frame bearings 41 are steel ball bearings.

The weapon cover (FIG. 1, Item F) is a non structural component that is configured to attach to the main receiver 30 and to cover the counter rotating cylinders 2*a* and 2*b* and the firing pin spool 18 (FIGS. 2 and 3) when the machine gun 1 is in operation, to minimize the possibility of foreign objects being fed into the mechanism.

The accessory handle (FIG. 1, Item J) is used to carry the weapon, to visually align on a target, and to mount optical firearm accessories.

The weapon system may be mounted to a host vehicle by means of an optional weapon swivel mount (FIG. 1, Item H) that is attached to the main receiver 30 (FIG. 9). The weapon swivel mount (FIG. 1, Item H) provides a centrally located reference point that allows the weapon system to attach to a host vehicle, and rotate and traverse while in operation without compromising the mechanical integrity of the machine gun 1. With minor modifications, the operation of the weapon system can be converted to operate in either a clockwise or counter clockwise rotational fashion depending upon host vehicle mounting requirements.

During one revolution of the firing pin spool 18 and the drive cylinders 2*a* and 2*b*, eight ammunition rounds are fired. With reliance on standard bolts and extraction methods eliminated, the rate of fire of the weapon can be adjusted to as needed depending upon the amount of current flowing through the drive motor 37. The rate of fire is controlled by the drive motor 37 via the variable speed trigger and grip 39 assembly. For example, if the weapon operates at 500 revolutions per minute, the total rate of fire is 4000 rounds per minute, (i.e., eight rounds per revolution times five hundred revolutions per minute equals four thousand rounds per minute).

Figure 12:
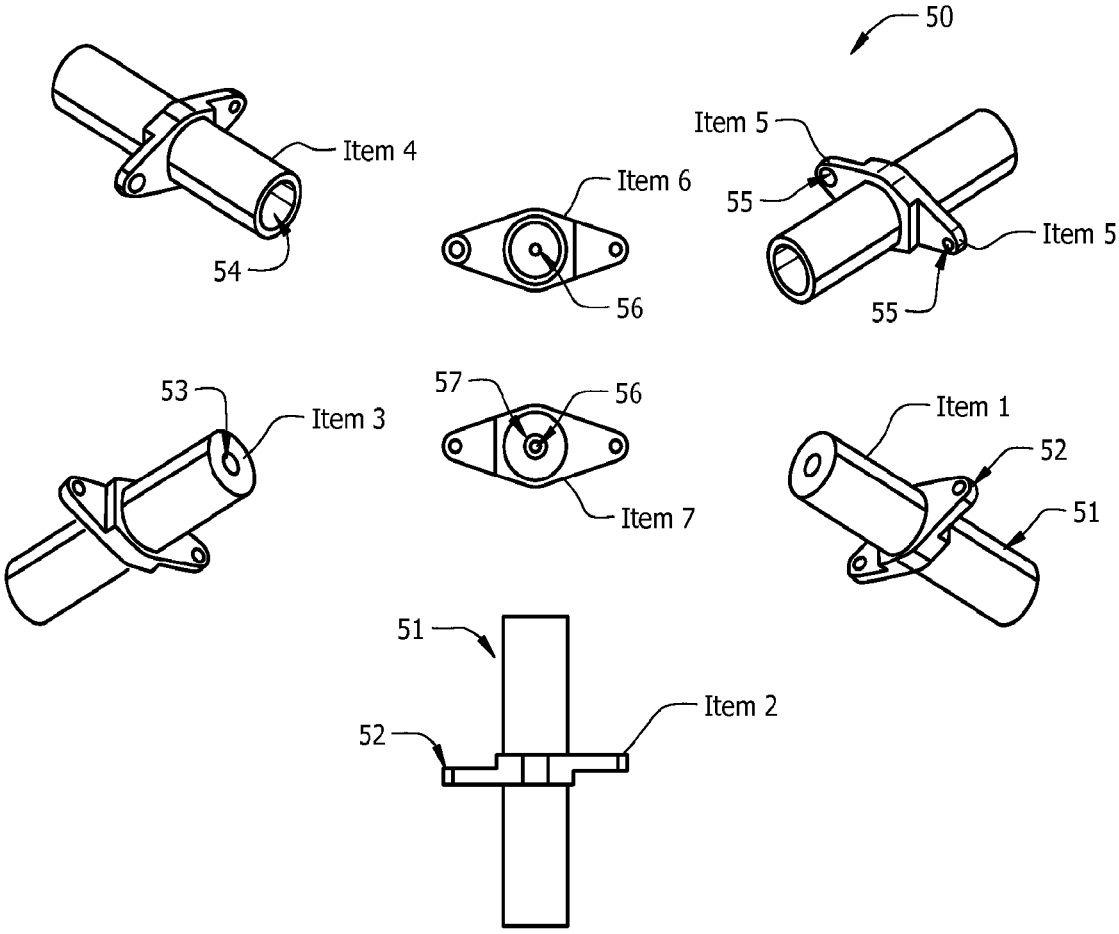
FIG. 12 is a plurality of views of the ammunition case and link.

A plurality of views of an embodiment of an ammunition case and link is shown in FIG. 12. The ammunition case and link 50 is depicted from the aft or primer position (FIG. 12, Item 1) of the ammunition case 51. As shown in FIG. 12, the ammunition case and link 50 comprises an ammunition case 51 and an ammunition link 52.

The ammunition case 51 may be machined, cast, deep drawn or otherwise manufactured from a variety of materials including, but not limited to, stainless steel (all types), titanium, aluminum, brass, and combinations thereof. Alternatively, the ammunition case 51 may be made from plastics, polymers, composites, synthetics and combinations thereof.

In an embodiment, the ammunition case 51 may be machined, cast or manufactured to accept a conventional rifle primer 53 (FIG. 12, Item 3) as is used in conventional center-fired ammunition. The ammunition case 51 may be used to deploy a variety of projectile packages ranging in size from the 0.17 Hornady® Magnum Rimfire (HMR) to the 0.50 Browning® Machine Gun (BMG) cartridge. The case 51 may also be configured to deploy non-lethal projectiles (e.g., buck shot) and other specialty projectiles. Accordingly, this ammunition case 51 allows numerous different calibers and projectile types to be fired from the same weapon system.

A sabot 63 is pressed into the chamber 54 of the ammunition case 51. The sabot 63 contains the projectile 64 and the propellant 62. See FIG. 13. The external diameter of the sabot 63 remains constant, however, the internal diameter of the sabot 63 varies to match the caliber of projectile 64 to be employed. Accordingly, the sabot 63 may be replaced to accommodate different calibers of projectiles in the ammunition case 51.

In order to change caliber or projectile type, only three alterations must be made to the weapon system: 1) ammunition cartridge 73 or projectile type 64 and propellant 62, 2) sabot 63, and 3) barrels 25. In particular, the barrels 25 of the machine gun 1 must be the same caliber as the ammunition cartridge or projectile type employed. No other machine gun 1 alterations are necessary to change calibers or projectile type.

The ammunition link 52 (FIG. 12, Item 2) may be either be integrally machined or cast with the ammunition case 51, or, alternatively, the link 52 may be separately machined, deep drawn, cast or stamped and press-fit onto the ammunition case 51. If the link 52 is made separately, the ammunition link 52 may be machined, cast, deep drawn or otherwise manufactured from a variety of materials including, but not limited to, stainless steel (all types), titanium, aluminum, brass, and combinations thereof. Alternatively, the link 52 may be made from plastics, polymers, composites, synthetics and combinations thereof.

The ammunition links 52 serve the purpose of joining individual ammunition cases 51 together to form an ammunition belt 80. The ammunition link 52 also serves as a pivotal point for the ammunition belt 80, resulting in flexibility of the belt 80.

An orifice 55 (FIG. 12, Item 5) on each of the wings of the ammunition link 52 allow the individual links 52 to be joined together to form an ammunition belt 80. The orifice 55 may be machined to accept counter set screws or, alternatively, the orifice 55 may be machined to accept metal, plastic, polymer, composite or synthetic rivets. A set screw, rivet or any other suitable fastener may be used to attach one link to another.

The empty ammunition case 51 is depicted from the front or projectile end (FIG. 12, Item 6) of the ammunition case 51. A fire hole 56 on the aft or primer position of the ammunition case 51 is also shown in this view. The fire hole 56 is a cylindrical opening in front of the primer receptacle 57 that allows fire from the primer 61 to reach the propellant or powder charge 62 to ignite the propellant or powder charge 62 and fire the projectile 64.

The ammunition case 51 is depicted from the aft or primer end (FIG. 12, Item 7) of the ammunition case 51. The fire hole 56 and the primer receptacle 53 are also shown in this view.

Figure 13:
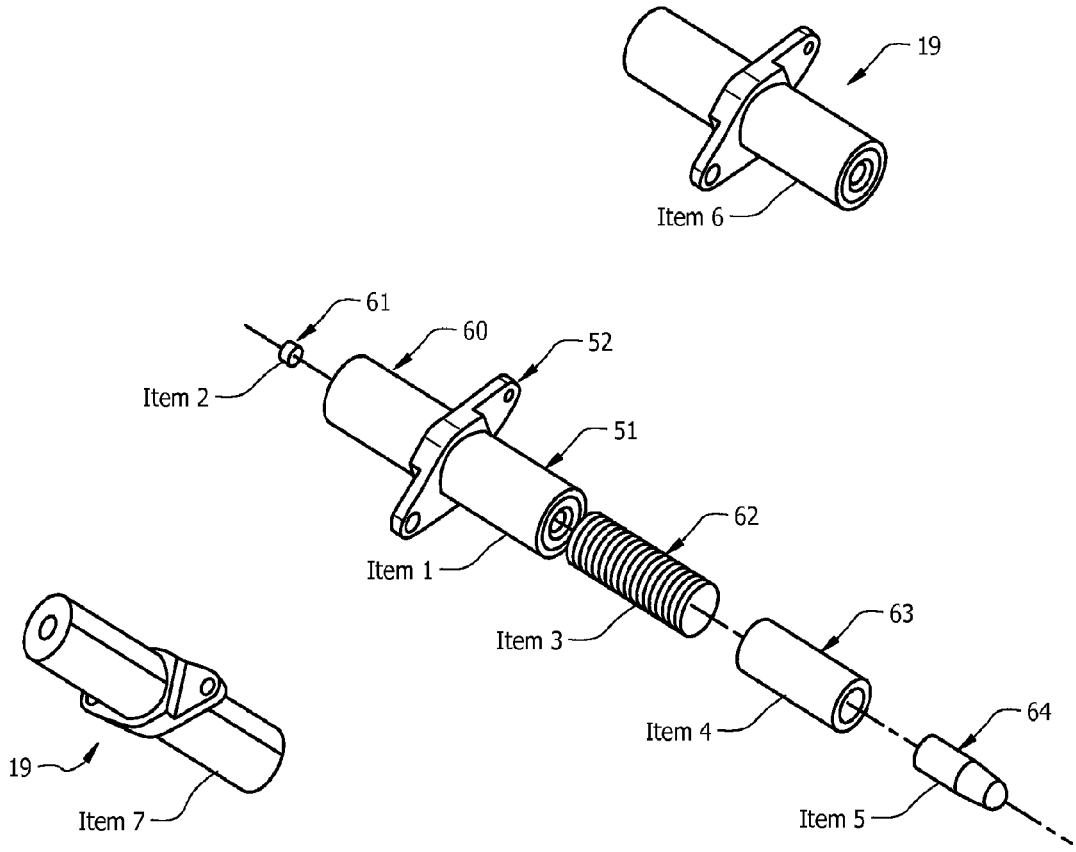
FIG. 13 is a longitudinal exploded side view of the ammunition case and link assembly.

An ammunition case and link assembly is shown in FIG. 13. As shown in FIG. 13, a complete ammunition round 19 comprises an ammunition case and link 50 (FIG. 12, Item 2), a rifle primer 61 (FIG. 13, Item 2), propellant or powder charge 62 (FIG. 13, Item 3), a sabot 63 (FIG. 13, Item 4) and a projectile 64 (FIG. 13, Item 5). The ammunition round 19 is depicted from the front or projectile end (FIG. 13, Item 6) of the ammunition case 51, and from the aft or primer end (Item 7).

The conventional rifle primer (FIG. 13, Item 2) is press-fit into the machined or cast primer receptacle 53 on the aft or primer end of the ammunition case 51. The sabot 63 (FIG. 13, Item 4) is press-fit into the machined or case chamber 54 on the front end of the ammunition case 51. The sabot 63 contains the propellant or powder charge 62 (Item 3) and the projectile 64 (Item 5).

Figure 14:
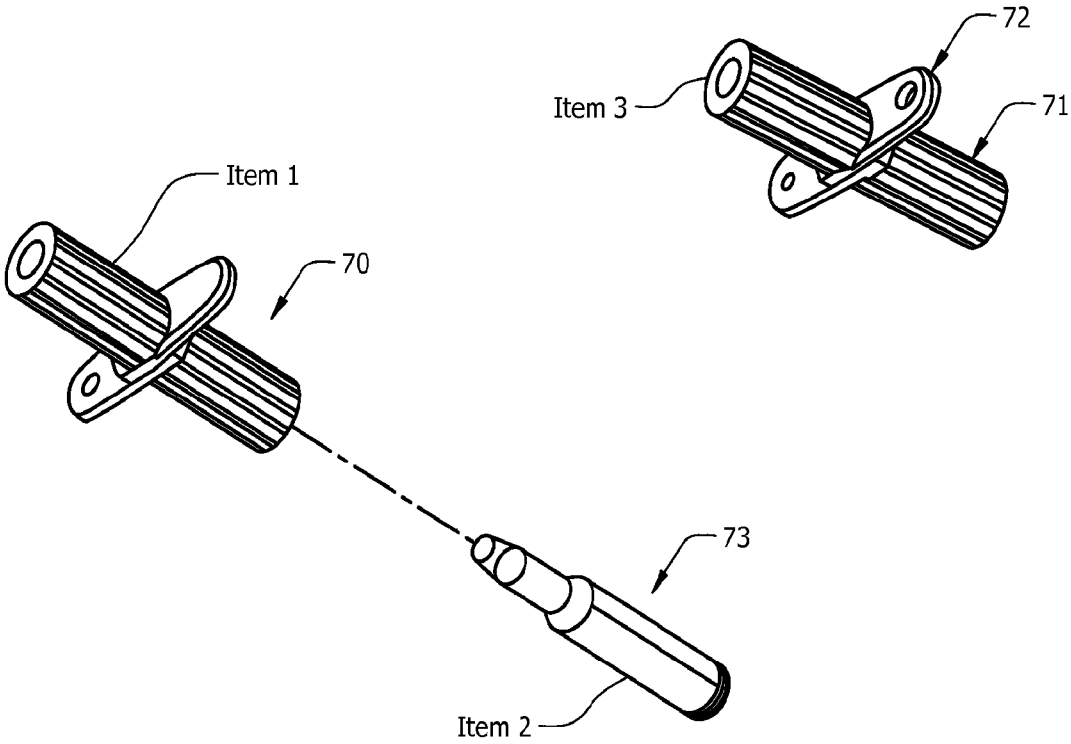
FIG. 14 is a longitudinal exploded side view of the conventional center-fire ammunition case and link assembly.

Another ammunition case and link assembly is shown in FIG. 14. As shown in FIG. 14, a complete conventional center-fire ammunition round 69 comprises a conventional center-fire ammunition case and link 70 (Item 1), and a conventional center-fire cartridge 73 (Item 2). The conventional center-fire ammunition case and link 70 further comprises a conventional center-fire ammunition case 71 and a conventional center-fire ammunition link 72.

The conventional center-fire ammunition case 71 may be machined, cast, deep drawn or otherwise manufactured from a variety of materials including, but not limited to, stainless steel (all types), titanium, aluminum, brass, and combinations thereof. Alternatively, the conventional center-fire ammunition case 71 may be made from plastics, polymers, composites, synthetics and combinations thereof.

The conventional center-fire ammunition case 71 may be manufactured to deploy any caliber of conventionally manufactured center-fire ammunition 72 from the 0.17 Hornady® Magnum Rimfire (HMR) to the 0.50 Browning® Machine Gun (BMG) cartridge. Accordingly, this ammunition case 71 allows numerous different calibers to be fired from the same weapon system.

The conventional center-fire ammunition link 72 may be either be integrally machined or cast with the conventional center-fire ammunition case 71, or, alternatively, the link 72 may be separately machined, deep drawn, cast or stamped and press-fit onto the ammunition case 71. If the link 72 is made separately, the conventional center-fire ammunition link 72 may be machined, cast, deep drawn or otherwise manufactured from a variety of materials including, but not limited to, stainless steel (all types), titanium, aluminum, brass, and combinations thereof. Alternatively, the link 72 may be made from plastics, polymers, composites, synthetics and combinations thereof.

The conventional center-fire cartridge 73 is inserted into the aft end of the conventional center-fire ammunition case 71. Each conventional center-fire ammunition case 71 is caliber specific because each case 71 is manufactured to accept a single caliber only. Importantly, the machine gun 1 can fire either the ammunition round 19 or the conventional center-fire ammunition round 69 interchangeably for identical calibers.

Figure 15:
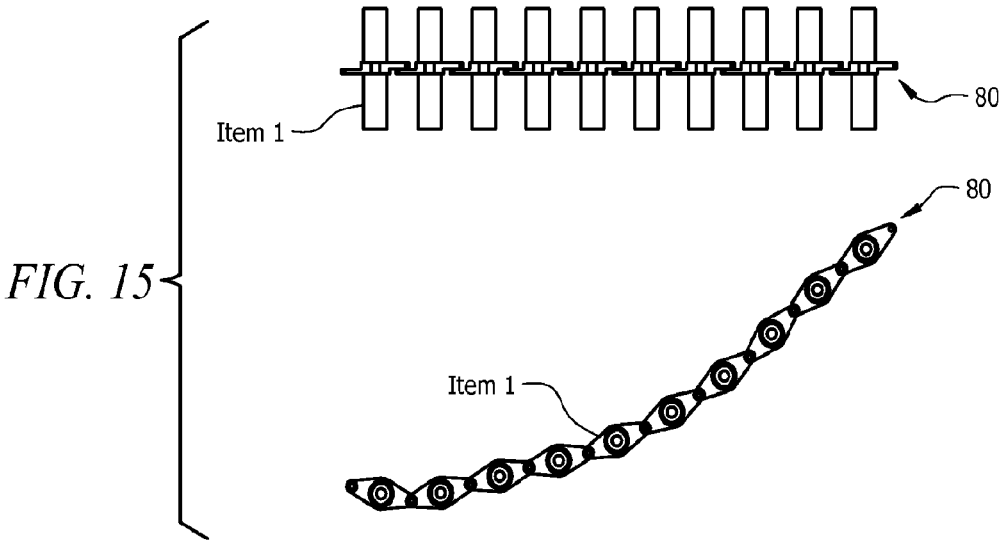
FIG. 15 is a fragmentary top and side view of an ammunition belt.

An embodiment of an ammunition belt is shown in FIG. 15. As shown in FIG. 15, a plurality of individual ammunition cases and links 50 may be joined together to form an ammunition belt 80. As discussed above, the ammunition case and link 50 may be made from an integral piece of material or the ammunition case 51 and ammunition link 52 may be made from separate pieces and press-fit together. In either case, the orifices 55 on the wings of the ammunition links 52 enable individual links 52 to be joined together to form the ammunition belt 80. Each orifice 55 may be machined to accept counter set screws or rivets, which serve to attach one link to another. The set screws or rivets may be machined, cast, deep drawn or otherwise manufactured from a variety of materials including, but not limited to metals, plastics, polymers, composites, synthetics or combinations thereof.

In FIG. 15, the upper illustration is a top or bottom view of the ammunition belt 80; and the lower illustration is a front view of the ammunition belt 80 (i.e., toward the projectile).

Figure 16:
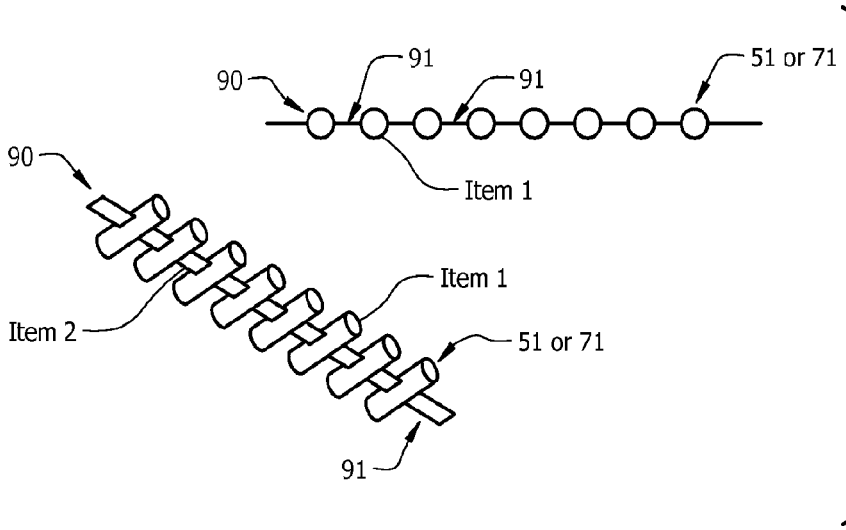
FIG. 16 is a fragmentary side and bottom view of a linkless ammunition belt.

An embodiment of a linkless ammunition belt is shown in FIG. 16. As shown in FIG. 16, individual, linkless ammunition cases 51 are inserted into a flexible belt 91. The belt 91 may be made from a variety of heat resistant, flexible materials including, but not limited to, cotton, rayon, nylon, leather, plastic, polymer, rubber composites, synthetics and combinations thereof. The linkless ammunition belt 90 is designed to be lighter and more flexible than the ammunition belt 80 shown in FIG. 15.

DEFINITIONS

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone: A and B in combination; A and C in combination; B and C in combination; or A, B, and C in combination.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. A weapon system comprising:

a) a plurality of barrels, wherein the barrels are disposed coaxially around a first shaft and wherein the barrels are held in place by at least one barrel rack;

b) a plurality of intermeshing, counter rotating cylinders, wherein a first cylinder has a central hole for the first shaft and a second cylinder has a central hole for a second shaft and the first cylinder and the second cylinder both have a plurality of coaxial half-holes disposed around the central hole at the edge of the cylindrical shape to form a chamber when the cylinders mesh; and c) a firing pin spool and cam assembly, wherein the firing pin spool and cam assembly comprises:

i. a spool, wherein the spool comprises a first round plate with a central hole for the first shaft and a plurality of coaxial holes disposed around the central hole to accommodate a plurality of firing pins, a second round plate with a central hole for the first shaft and a plurality of holes disposed around the central hole to accommodate a plurality of guides;

ii. a plurality of blocks, wherein each block is secured to the spool by means of the guides and wherein each firing pin extends from a tip of the block;

iii. a plurality of springs, wherein each spring is disposed under the blocks; and iv. a cam, wherein the cam is an inclined sleeve disposed around the spool and wherein the spool rotates within the cam.

2. The weapon system of claim 1 further comprising a muzzle flash suppressor attached to a front end of the first shaft, wherein the muzzle flash suppressor laterally stabilizes the barrels.

3. The weapon system of claim 1 further comprising a drive motor, wherein a drive motor shaft is attached to the first shaft.

4. The weapon system of claim 1 further comprising an ammunition round disposed and held in place within the chamber, wherein the ammunition round is oriented such that a primer is towards the rear of the weapon system and a projectile is towards the front of the weapon system.

5. The weapon system of claim 1, wherein the first cylinder is attached to the barrel assembly by means of the first shaft that is compressed through a first shaft mounting hole and through a barrel interlock.

6. The weapon system of claim 1, wherein the second cylinder is attached to a main receiver by means of a second shaft that is compressed through a second shaft mounting hole.

7. The weapon system of claim 1, wherein the barrels are made from chromoly steel, stainless steel, titanium or combinations thereof.

8. The weapon system of claim 1, wherein the first shaft and the second shaft are made from hardened steel.

9. The weapon system of claim 1, wherein the barrel racks are made from low carbon steel.

10. The weapon system of claim 1, wherein the counter rotating cylinders are made from carbon steel, titanium or combinations thereof.

11. The weapon system of claim 2, wherein the muzzle flash suppressor is made from low carbon steel.

12. The weapon system of claim 3, wherein the drive motor is a variable speed, bi-directional electrical motor.

13. The weapon system of claim 1, wherein the firing pins are made from tool steel.

14. An automatic weapon system comprising:

a) a barrel and rack assembly comprising:

i. a first shaft attached to a main receiver;

ii. a plurality of barrel racks attached to the first shaft, wherein the barrel racks are a round plate with a central hole for the first shaft and a plurality of coaxial holes disposed around the central hole to accommodate the barrels;

iii. a plurality of cylindrical barrels, wherein the barrels are disposed coaxially around the first shaft and wherein the barrels are held in place by the barrel racks; and iv. a barrel interlock attached to the first shaft, wherein the barrel interlock is a round plate with a central hole for the first shaft and a plurality of coaxial holes disposed around the central hole to accommodate the barrels, and wherein each barrel is attached to the barrel drive cylinder;

b) a cylinder assembly comprising:

i. a plurality of intermeshing, counter rotating cylinders, wherein the cylinders are a cylindrical shape, wherein a first cylinder has a central hole for the first shaft and a second cylinder has a central hole for a second shaft and the first cylinder and the second cylinder both have a plurality of coaxial half-holes disposed around the central hole at the edge of the cylindrical shape to form a chamber when the cylinders mesh, wherein the first cylinder is attached to the barrel assembly by means of the first shaft that is compressed through a first shaft mounting hole and through the barrel interlock, and wherein the second cylinder is attached to the main receiver by means of the second shaft that is compressed through a second the lower shaft mounting hole.

15. The weapon system of claim 14 further comprising a cylinder retainer frame assembly, wherein the cylinder retainer frame assembly comprises:

a) a cylinder retainer frame attached to the main receiver; and b) a plurality of retainer frame bearings disposed within the cylinder retainer frame, wherein the cylinder retainer ring is disposed around the aft end of the barrel assembly, and wherein the retainer frame bearings allow the barrel assembly to rotate.

16. The weapon system of claim 14 further comprising a muzzle flash suppressor attached to a front end of the first shaft, wherein the muzzle flash suppressor laterally stabilizes the barrels.

17. The weapon system of claim 14 further comprising a drive motor, wherein a drive motor shaft is attached to the first shaft.

18. The weapon system of claim 14 further comprising a firing pin spool and cam assembly, wherein the firing pin spool and cam assembly comprises:

a) a firing pin spool, wherein the spool comprises a first round plate with a central hole for the first shaft and a plurality of coaxial holes disposed around the central hole to accommodate a plurality of firing pins, and a second round plate with a central hole for the first shaft and a plurality of holes disposed around the central hole to accommodate a plurality of guides;

b) a plurality of blocks, wherein each block is secured to the spool by means of the guides and wherein each firing pin extends from a tip of the block;

c) a plurality of springs, wherein each spring is disposed under the blocks;

d) a cam, wherein the cam is an inclined sleeve disposed around the spool; and e) a plurality of cam bearings, wherein the cam bearings allow the spool to rotate inside the cam.

19. The weapon system of claim 14 further comprising an ammunition round disposed and held in place within the barrel interlock chamber, wherein the ammunition round is oriented such that a primer is towards the rear of the weapon system and a projectile is towards the front of the weapon system.

20. The weapon system of claim 14, wherein the barrels are made from chromoly steel, stainless steel, titanium or combinations thereof.

21. The weapon system of claim 15, wherein the barrel racks are made from low carbon steel.

22. The weapon system of claim 14, wherein the counter rotating cylinders are made from carbon steel.

23. The weapon system of claim 16, wherein the muzzle flash suppressor is made from low carbon steel.

24. The weapon system of claim 17, wherein the drive motor is a variable speed, bi-directional electrical motor.

25. The weapon system of claim 18, wherein the firing pins are made from tool steel.

26. A method of using an automatic weapon system of claim 1 comprising the steps of:

a) feeding an ammunition round into a feed chute; and b) forming a chamber around the ammunition round.

27. The method of claim 26 further comprising the step of striking a primer in the ammunition round.

28. A method of using a weapon system of claim 14 comprising the steps of:

a) feeding an ammunition round into a feed chute;

b) forming a chamber around the ammunition round; and c) striking a primer in the ammunition round.

* * * * *